US009365028B2

(12) United States Patent
Vogel et al.

(10) Patent No.: US 9,365,028 B2
(45) Date of Patent: Jun. 14, 2016

(54) METHOD FOR FINISHING A BUILDING BOARD AND BUILDING BOARD

(75) Inventors: Hans Vogel, Ruswil LU (CH); Frank Oldorff, Schwerin (DE)

(73) Assignee: FLOORING TECHNOLOGIES LTD., Pieta (MT)

( * ) Notice: Subject to any disclaimer, the term of this patent is extended or adjusted under 35 U.S.C. 154(b) by 403 days.

(21) Appl. No.: 11/674,743

(22) Filed: Feb. 14, 2007

(65) Prior Publication Data

US 2007/0193174 A1 Aug. 23, 2007

(30) Foreign Application Priority Data

Feb. 21, 2006 (DE) ..... 10 2006 007 976

(51) Int. Cl.

| | |
|---|---|
| ***B41F 19/02*** | (2006.01) |
| ***E04F 15/02*** | (2006.01) |
| ***B44C 1/24*** | (2006.01) |
| ***B44B 5/00*** | (2006.01) |
| ***B44C 5/04*** | (2006.01) |
| ***B44F 9/02*** | (2006.01) |
| ***B44F 9/04*** | (2006.01) |
| ***E04F 13/08*** | (2006.01) |

(52) U.S. Cl.

CPC ..... *B41F 19/02* (2013.01); *B44B 5/0009* (2013.01); *B44C 1/24* (2013.01); *B44C 5/0492* (2013.01); *B44F 9/02* (2013.01); *B44F 9/04* (2013.01); *E04F 13/08* (2013.01); *E04F 15/02* (2013.01)

(58) Field of Classification Search

CPC ..... B44C 5/0492; B44C 5/0469; B44C 1/24; E04F 15/107; B41F 19/062; B41F 19/02; B44B 5/0009; B44B 5/0047; B44B 5/008

USPC ..... 101/3.1, 22, 23

See application file for complete search history.

(56) References Cited

U.S. PATENT DOCUMENTS

| | | | |
|---|---|---|---|
| 213,740 | A | 4/1879 | Conner |
| 623,562 | A | 4/1899 | Rider |
| 714,987 | A | 12/1902 | Wolfe |
| 753,791 | A | 3/1904 | Fulghum |
| 1,407,679 | A | 2/1922 | Ruthrauff |
| 1,454,250 | A | 5/1923 | Parsons |

(Continued)

FOREIGN PATENT DOCUMENTS

| | | |
|---|---|---|
| AU | 200020703 | 1/2000 |
| CA | 991373 | 6/1976 |

(Continued)

OTHER PUBLICATIONS

JP 48040908 A, Goto (Asignee), Jun. 15, 1973, patent abstract.*

(Continued)

*Primary Examiner* — Daniel J Colilla

(74) *Attorney, Agent, or Firm* — Andrew M. Calderon; Roberts Mlotkowski Safran & Cole, P.C.

(57) ABSTRACT

A method for finishing a building board, in particular a wood material or plastic board or a mixture of wood material and plastic. The building board includes a top side and an underside and opposite side edges. The method includes embossing a structure and/or a relief in at least the top side of the building board. A pattern is applied to the embossed side of the building board. The pattern is sealed by the application of an abrasion-resistant layer to the pattern.

12 Claims, 2 Drawing Sheets

(56) References Cited

U.S. PATENT DOCUMENTS 1,468,288 A 9/1923 Een
1,477,813 A 12/1923 Daniels
1,510,924 A 10/1924 Daniels et al.
1,540,128 A 6/1925 Houston
1,575,821 A 3/1926 Daniels
1,602,256 A 10/1926 Sellin
1,602,267 A 10/1926 Karwisch
1,615,096 A 1/1927 Meyers
1,622,103 A 3/1927 Fulton
1,622,104 A 3/1927 Fulton
1,637,634 A 8/1927 Carter
1,644,710 A 10/1927 Crooks
1,660,480 A 2/1928 Daniels
1,714,738 A 5/1929 Smith
1,718,702 A 6/1929 Pfiester
1,734,826 A 11/1929 Pick
1,764,331 A 6/1930 Moratz
1,776,188 A 9/1930 Langb'aum
1,778,069 A 10/1930 Fetz
1,779,729 A 10/1930 Bruce
1,787,027 A 12/1930 Wasleff
1,823,039 A 9/1931 Guner
1,859,667 A 5/1932 Gruner
1,898,364 A 2/1933 Gynn
1,906,411 A 5/1933 Potvin
1,921,164 A 8/1933 Lewis
1,929,871 A 10/1933 Jones
1,940,377 A 12/1933 Storm
1,946,648 A 2/1934 Taylor
1,953,306 A 4/1934 Moratz
1,986,739 A 1/1935 Mitte
1,988,201 A 1/1935 Hall
2,023,066 A 12/1935 Curtis et al.
2,044,216 A 6/1936 Klages
2,065,525 A 12/1936 Hamilton
2,123,409 A 7/1938 Elmendorf
2,213,296 A * 9/1940 Zinser ..... 428/162
2,220,606 A 11/1940 Malarkey et al.
2,276,071 A 3/1942 Scull
2,280,071 A 4/1942 Hamilton
2,324,628 A 7/1943 Kähr
2,328,051 A 8/1943 Bull
2,398,632 A 4/1946 Frost et al.
2,430,200 A 11/1947 Wilson
2,740,167 A 4/1956 Rowley
2,894,292 A 7/1959 Gramelspacker
3,045,294 A 7/1962 Livezey, Jr.
3,100,556 A 8/1963 De Ridder
3,125,138 A 3/1964 Bolenbach
3,182,769 A 5/1965 De Ridder
3,203,149 A 8/1965 Soddy
3,204,380 A 9/1965 Smith et al.
3,267,630 A 8/1966 Omholt
3,282,010 A 11/1966 King, Jr.
3,310,919 A 3/1967 Bue et al.
3,347,048 A 10/1967 Brown et al.
3,460,304 A 8/1969 Braeuninger et al.
3,481,810 A 12/1969 Waite
3,526,420 A 9/1970 Brancaleone
3,538,665 A 11/1970 Gohner
3,553,919 A 1/1971 Omholt
3,555,762 A 1/1971 Costanzo, Jr.
3,608,258 A 9/1971 Spratt
3,681,159 A * 8/1972 Portnoy et al. ..... 156/209
3,694,983 A 10/1972 Couquet
3,714,747 A 2/1973 Curran
3,720,027 A 3/1973 Christensen
3,731,445 A 5/1973 Hoffmann et al.
3,759,007 A 9/1973 Thiele
3,760,548 A 9/1973 Sauer et al.
3,768,846 A 10/1973 Hensley et al.
3,793,125 A * 2/1974 Kunz ..... 156/62.2
3,859,000 A 1/1975 Webster
3,878,030 A 4/1975 Cook
3,902,293 A 9/1975 Witt et al.
3,908,053 A 9/1975 Hettich
3,936,551 A 2/1976 Elmendorf et al.
3,988,187 A 10/1976 Witt et al.
4,006,048 A 2/1977 Cannady, Jr. et al.
4,090,338 A 5/1978 Bourgade
4,091,136 A 5/1978 O'Brien et al.
4,099,358 A 7/1978 Compaan
4,113,894 A * 9/1978 Koch, II ..... 427/494
4,118,533 A 10/1978 Hipchen et al.
4,131,705 A 12/1978 Kubinsky
4,164,832 A 8/1979 Van Zandt
4,169,688 A 10/1979 Toshio
4,237,087 A * 12/1980 Jones ..... 264/134
4,242,390 A 12/1980 Nemeth
4,243,716 A 1/1981 Kosaka et al.
4,245,689 A 1/1981 Grard et al.
4,246,310 A 1/1981 Hunt et al.
4,290,248 A 9/1981 Kemerer et al.
4,299,070 A 11/1981 Oltmanns et al.
4,426,820 A 1/1984 Terbrack et al.
4,431,044 A 2/1984 Bruneau
4,471,012 A 9/1984 Maxwell
4,501,102 A 2/1985 Knowles
4,561,233 A 12/1985 Harter et al.
4,579,767 A * 4/1986 Coggan et al. ..... 428/161
4,585,685 A 4/1986 Forry et al.
4,612,745 A 9/1986 Hovde
4,641,469 A 2/1987 Wood
4,653,242 A 3/1987 Ezard
4,654,244 A 3/1987 Eckert et al.
4,698,257 A * 10/1987 Goll ..... 428/171
4,703,597 A 11/1987 Eggemar
4,715,162 A 12/1987 Brightwell
4,738,071 A 4/1988 Ezard
4,752,497 A 6/1988 McConkey et al.
4,769,963 A 9/1988 Meyerson
4,819,932 A 4/1989 Trotter, Jr.
4,831,806 A 5/1989 Niese et al.
4,845,907 A 7/1989 Meek
4,905,442 A 3/1990 Daniels
4,947,602 A 8/1990 Pollasky
5,029,425 A 7/1991 Bogataj
5,103,614 A 4/1992 Kawaguchi et al.
5,113,632 A 5/1992 Hanson
5,117,603 A 6/1992 Weintraub
5,136,823 A 8/1992 Pellegrino
5,141,583 A * 8/1992 Held ..... 156/324
5,165,816 A 11/1992 Parasin
5,179,812 A 1/1993 Itill
5,205,091 A 4/1993 Brown
5,216,861 A 6/1993 Meyerson
5,251,996 A 10/1993 Hiller et al.
5,253,464 A 10/1993 Nilsen
5,283,102 A 2/1994 Sweet et al.
5,295,341 A 3/1994 Kajiwara
5,335,473 A 8/1994 Chase
5,348,778 A 9/1994 Knipp et al.
5,349,796 A 9/1994 Meyerson
5,390,457 A 2/1995 Sjölander
5,413,834 A 5/1995 Hunter et al.
5,433,806 A 7/1995 Pasquali et al.
5,474,831 A 12/1995 Nystrom
5,497,589 A 3/1996 Porter
5,502,939 A 4/1996 Zadok et al.
5,534,352 A * 7/1996 Pittman et al. ..... 428/535
5,540,025 A 7/1996 Takehara et al.
5,567,497 A 10/1996 Zegler et al.
5,570,554 A 11/1996 Searer
5,597,024 A 1/1997 Bolyard et al.
5,630,304 A 5/1997 Austin
5,653,099 A 8/1997 MacKenzie
5,671,575 A 9/1997 Wu
5,694,734 A 12/1997 Cercone et al.
5,706,621 A 1/1998 Pervan
5,736,227 A 4/1998 Sweet et al.
5,768,850 A 6/1998 Chen
5,797,175 A 8/1998 Schneider
5,797,237 A 8/1998 Finkell, Jr.
5,823,240 A 10/1998 Bolyard et al.

(56) References Cited

U.S. PATENT DOCUMENTS 5,827,592 A 10/1998 Van Gulik et al.
5,860,267 A 1/1999 Pervan
5,935,668 A 8/1999 Smith
5,943,239 A 8/1999 Shamblin et al.
5,953,878 A 9/1999 Johnson
5,968,625 A 10/1999 Hudson
5,985,397 A 11/1999 Witt et al.
5,987,839 A 11/1999 Hamar et al.
6,006,486 A 12/1999 Moriau et al.
6,023,907 A 2/2000 Pervan
6,065,262 A 5/2000 Motta
6,094,882 A 8/2000 Pervan
6,101,778 A 8/2000 Martensson
6,119,423 A 9/2000 Costantino
6,134,854 A 10/2000 Stanchfield
6,148,884 A 11/2000 Bolyard et al.
6,168,866 B1 1/2001 Clark
6,182,410 B1 2/2001 Pervan
6,186,703 B1 2/2001 Shaw
6,205,639 B1 3/2001 Pervan
6,209,278 B1 4/2001 Tychsen
6,216,403 B1 4/2001 Belbeoc'h
6,216,409 B1 4/2001 Roy et al.
D442,296 S 5/2001 Külik
D442,297 S 5/2001 Külik
D442,298 S 5/2001 Külik
D442,706 S 5/2001 Külik
D442,707 S 5/2001 Külik
6,224,698 B1 5/2001 Endo
6,238,798 B1 5/2001 Kang et al.
6,247,285 B1 6/2001 Moebus
D449,119 S 10/2001 Külik
D449,391 S 10/2001 Külik
D449,392 S 10/2001 Külik
6,309,492 B1 * 10/2001 Seidner ..... 156/94
6,312,632 B1 * 11/2001 Graf ..... 264/119
6,324,803 B1 12/2001 Pervan
6,344,101 B1 * 2/2002 Graf ..... 156/220
6,345,481 B1 2/2002 Nelson
6,363,677 B1 4/2002 Chen et al.
6,397,547 B1 6/2002 Martensson
6,401,415 B1 6/2002 Garcia
6,418,683 B1 7/2002 Martensson et al.
6,421,970 B1 7/2002 Martensson et al.
6,427,408 B1 8/2002 Krieger
6,436,159 B1 8/2002 Safta et al.
6,438,919 B1 8/2002 Knauseder
6,446,405 B1 9/2002 Pervan
6,449,913 B1 9/2002 Shelton
6,449,918 B1 9/2002 Nelson
6,453,632 B1 9/2002 Huang
6,458,232 B1 10/2002 Valentinsson
6,460,306 B1 10/2002 Nelson
6,461,636 B1 10/2002 Arth et al.
6,465,046 B1 10/2002 Hansson et al.
6,490,836 B1 12/2002 Moriau et al.
6,497,961 B2 12/2002 Kang et al.
6,510,665 B2 1/2003 Pervan
6,516,579 B1 2/2003 Pervan
6,517,935 B1 2/2003 Kornfalt et al.
6,519,912 B1 2/2003 Eckmann et al.
6,521,314 B2 2/2003 Tychsen
6,532,709 B2 3/2003 Pervan
6,533,855 B1 3/2003 Gaynor et al.
6,536,178 B1 3/2003 Pålsson et al.
6,546,691 B2 4/2003 Peopolder
6,553,724 B1 4/2003 Bigler
6,558,754 B1 5/2003 Velin et al.
6,565,919 B1 5/2003 Hansson et al.
6,569,272 B2 5/2003 Tychsen
6,588,166 B2 7/2003 Martensson et al.
6,591,568 B1 7/2003 Palsson
6,601,359 B2 8/2003 Olofsson
6,606,834 B2 8/2003 Martensson et al.
6,617,009 B1 9/2003 Chen et al.
6,635,174 B1 10/2003 Berg et al.
6,638,387 B2 10/2003 Cruz
6,641,629 B2 11/2003 Muselman et al.
6,646,088 B2 11/2003 Fan et al.
6,647,690 B1 11/2003 Martensson
6,649,687 B1 11/2003 Gheewala et al.
6,659,097 B1 12/2003 Houston
6,672,030 B2 1/2004 Schulte
6,675,545 B2 1/2004 Chen et al.
6,681,820 B2 1/2004 Olofsson
6,682,254 B1 1/2004 Olofsson et al.
6,685,993 B1 2/2004 Hansson et al.
6,688,061 B2 2/2004 Garcia
6,711,864 B2 3/2004 Erwin
6,711,869 B2 3/2004 Tychsen
6,715,253 B2 4/2004 Pervan
6,723,438 B2 4/2004 Chang et al.
6,729,091 B1 5/2004 Martensson
6,745,534 B2 6/2004 Kornfalt
6,761,008 B2 7/2004 Chen et al.
6,761,794 B2 7/2004 Mott et al.
6,763,643 B1 7/2004 Martensson
6,766,622 B1 7/2004 Thiers
6,769,217 B2 8/2004 Nelson
6,769,218 B2 8/2004 Pervan
6,769,835 B2 8/2004 Stridsman
6,772,568 B2 8/2004 Thiers et al.
6,786,019 B2 9/2004 Thiers
6,803,109 B2 10/2004 Qiu et al.
6,805,951 B2 10/2004 Kornfält et al.
6,823,638 B2 11/2004 Stanchfield
6,841,023 B2 1/2005 Mott
1,124,228 A1 1/2015 Houston
2001/0029720 A1 10/2001 Pervan
2001/0034992 A1 11/2001 Pletzer et al.
2002/0007608 A1 1/2002 Pervan
2002/0007609 A1 1/2002 Pervan
2002/0014047 A1 2/2002 Thiers
2002/0020127 A1 2/2002 Thiers et al.
2002/0046528 A1 4/2002 Pervan et al.
2002/0056245 A1 5/2002 Thiers
2002/0106439 A1 8/2002 Cappelle
2002/0160680 A1 10/2002 Laurence et al.
2003/0024200 A1 2/2003 Moriau et al.
2003/0024201 A1 2/2003 Moriau et al.
2003/0029115 A1 2/2003 Moriau et al.
2003/0029116 A1 2/2003 Moriau et al.
2003/0029117 A1 2/2003 Moriau et al.
2003/0033777 A1 2/2003 Thiers et al.
2003/0033784 A1 2/2003 Pervan
2003/0115812 A1 6/2003 Pervan
2003/0115821 A1 6/2003 Pervan
2003/0159385 A1 8/2003 Thiers
2003/0167717 A1 9/2003 Garcia
2003/0196405 A1 10/2003 Pervan
2003/0205013 A1 11/2003 Garcia
2003/0233809 A1 12/2003 Pervan
2004/0016196 A1 1/2004 Pervan
2004/0035078 A1 2/2004 Pervan
2004/0092006 A1 5/2004 Lindekens et al.
2004/0105994 A1 6/2004 Lu et al.
2004/0139678 A1 7/2004 Pervan
2004/0159066 A1 8/2004 Thiers et al.
2004/0177584 A1 9/2004 Pervan
2004/0191547 A1 * 9/2004 Oldorff ..... 428/479.3
2004/0200165 A1 10/2004 Garcia et al.
2004/0206036 A1 10/2004 Pervan
2004/0228684 A1 * 11/2004 Lombardo ..... 404/41
2004/0237447 A1 12/2004 Thiers et al.
2004/0237448 A1 12/2004 Thiers et al.
2004/0241374 A1 12/2004 Thiers et al.
2004/0244322 A1 12/2004 Thiers et al.
2004/0250493 A1 12/2004 Thiers et al.
2004/0255541 A1 12/2004 Thiers et al.
2004/0258907 A1 12/2004 Kornfalt et al.
2005/0003149 A1 1/2005 Kornfalt et al.
2005/0016099 A1 1/2005 Thiers
2005/0166515 A1 * 8/2005 Boucke ..... 52/589.1
2006/0046034 A1 * 3/2006 Schober ..... 428/195.1

(56) References Cited

U.S. PATENT DOCUMENTS

| | | | | |
|---|---|---|---|---|
| 2006/0144004 | A1* | 7/2006 | Nollet et al. | 52/578 |
| 2006/0156672 | A1* | 7/2006 | Laurent et al. | 52/589.1 |
| 2007/0020475 | A1* | 1/2007 | Prince et al. | 428/537.1 |
| 2009/0101236 | A1* | 4/2009 | Boucke | 144/350 |

FOREIGN PATENT DOCUMENTS

| | | | | | |
|---|---|---|---|---|---|
| CA | 2226286 | | | 12/1997 | |
| CA | 2252791 | | | 5/1999 | |
| CA | 2289309 | | | 7/2000 | |
| CA | 2484852 | | | 11/2003 | |
| DE | 7102476 | | | 6/1971 | |
| DE | 8226153 | | | 1/1983 | |
| DE | 297 08 003 | | | 5/1997 | |
| DE | 19822627 | A1 | * | 11/1999 | |
| DE | 1 9903912 | | | 8/2000 | |
| EP | 0021588 | | | 8/1984 | |
| EP | 0248127 | | | 12/1987 | |
| EP | 791480 | A2 | * | 8/1997 | |
| EP | 0849416 | | | 6/1998 | |
| EP | 0698162 | | | 9/1998 | |
| EP | 0903451 | | | 3/1999 | |
| EP | 0855482 | | | 12/1999 | |
| EP | 0877130 | | | 1/2000 | |
| EP | 0969163 | | | 1/2000 | |
| EP | 0969164 | | | 1/2000 | |
| EP | 0974713 | | | 1/2000 | |
| EP | 0843763 | | | 10/2000 | |
| EP | 0958441 | | | 7/2003 | |
| EP | 1026341 | | | 8/2003 | |
| EP | 1 454 763 | | | 9/2004 | |
| GB | 424057 | | | 2/1935 | |
| GB | 1237744 | | | 6/1938 | |
| GB | 585205 | | | 1/1947 | |
| GB | 599793 | | | 3/1948 | |
| GB | 636423 | | | 4/1950 | |
| GB | 812671 | | | 4/1959 | |
| GB | 1033866 | | | 6/1966 | |
| GB | 1034117 | | | 6/1966 | |
| GB | 1044846 | | | 10/1966 | |
| GB | 1127915 | | | 9/1968 | |
| GB | 1275511 | | | 5/1972 | |
| GB | 1399402 | | | 7/1975 | |
| GB | 1430423 | | | 3/1976 | |
| GB | 2117813 | | | 10/1983 | |
| GB | 2126106 | | | 3/1984 | |
| GB | 2152063 | | | 7/1985 | |
| GB | 2238660 | | | 6/1991 | |
| GB | 2243381 | | | 10/1991 | |
| GB | 2256023 | | | 11/1992 | |
| JP | 50034379 | A | * | 4/1975 | B32B 15/08 |
| JP | 3-169967 | | | 7/1991 | |
| JP | 7-76923 | | | 3/1995 | |
| JP | 7-300979 | | | 11/1995 | |
| JP | 2001246720 | A | * | 9/2001 | B32B 33/00 |
| JP | 2005211707 | A | * | 8/2005 | B05D 5/06 |
| JP | 2005305728 | A | * | 11/2005 | B27D 5/00 |
| SE | 9803875 | A | * | 6/1999 | |
| WO | 87/03839 | | | 7/1987 | |
| WO | 89/08539 | | | 9/1989 | |
| WO | 92/17657 | | | 10/1992 | |
| WO | 9314422 | | | 7/1993 | |
| WO | 93/19910 | | | 10/1993 | |
| WO | 94/01628 | | | 1/1994 | |
| WO | 95/06176 | | | 3/1995 | |
| WO | 96/27719 | | | 9/1996 | |
| WO | 96/27721 | | | 9/1996 | |
| WO | 96/30177 | | | 10/1996 | |
| WO | 97/47834 | | | 12/1997 | |
| WO | 98/24495 | | | 6/1998 | |
| WO | 98/24994 | | | 6/1998 | |
| WO | 98/38401 | | | 9/1998 | |
| WO | 99140273 | | | 8/1999 | |
| WO | 99/66151 | | | 12/1999 | |
| WO | 9966152 | | | 12/1999 | |
| WO | 0006854 | | | 2/2000 | |
| WO | 0066856 | | | 11/2000 | |
| WO | 0166876 | | | 9/2001 | |

OTHER PUBLICATIONS

Machine translation of Heimes et al., DE 19822627, pp. 1-3, Nov. 25, 1999.*

Webster Dictionary, p. 862.

U.S. Court of Appeals for the Federal Circuit, 02-1222-1291 *Alloc, Inc.* vs. *International Trade Commission*, pp. 1-32.

U.S. Court of Appeals for the Federal Circuit Decision in *Alloc, Inc. et al.* vs. *International Trade Commission and Pergs, Inc. et al.* decided Sep. 10, 2003.

* cited by examiner

METHOD FOR FINISHING A BUILDING BOARD AND BUILDING BOARD

CROSS-REFERENCE TO RELATED APPLICATIONS

The present application claims priority under 35 U.S.C. §119 of German Patent Application No. 10 2006 007 976.0, filed on Feb. 21, 2006, the disclosure of which is expressly incorporated by reference herein in its entirety.

BACKGROUND OF THE INVENTION

1. Field of the Invention

The invention relates to a method for finishing a building board, in particular of a wood material, plastic or a mixture of wood material and plastic with a top side and an underside and opposite side edges, and a building board.

2. Discussion of Background Information

Building boards, e.g., flooring panels or wall and ceiling panels, are provided with a wood, stone or fantasy pattern with a superimposed, three-dimensional surface. The wood material boards have connecting mechanisms (e.g., tongue and groove) and are usually equipped with locking mechanisms for locking adjacent boards in the horizontal and vertical direction. A realistic optical and tactile impression of the imitated material is produced through the superimposition of a pattern and three-dimensional surface.

In particular, flooring panels are coated at least on the top side and have a pattern and a structure adapted to the pattern. A structure of this type is called a pattern-synchronous structure. The pattern is present either as a paper layer laminated to the support board or as a paint coat printed directly onto the support board. Moreover, the pattern is coated in an abrasion-resistant manner. To this end, either abrasion-resistant paper layers, so-called overlays, or varnish coats which are abrasion-resistant after curing are used.

MDF, HDF, chipboard or OSB boards as well as plastic boards are used as support boards. The pattern-synchronous structure is present as a three-dimensional surface structure and is embossed into the board surface by a correspondingly three-dimensionally structured pressing plate. The constituents of the coating that can be activated thermally and under pressure melt and flow and fill up the three-dimensional structural embossing and cure. The structure has a height of up to 500 μm, preferably 100 to 200 μm. The number and the depth of the structures are limited, on the one hand, by the available amount of constituents that can be activated and, on the other hand, by the press force.

In the production of building boards of this type, the patterning always takes place first followed by the application of the pattern-synchronous structure.

U.S. Pat. No. 6,401,415 B1 describes a laminate that is provided on the surface with impregnated cellulose sheets in which a structure is embossed in a mechanical press. The finished pressed boards have an optical and tactile texture that corresponds to the pattern of the surface.

U.S. Pat. No. 6,688,061 B2 describes a laminate material that contains cellulose sheets that have been impregnated with a polymer resin and mechanically pressed and cut. The laminate material has a surface with an external area, an edge contour and an internal area, whereby the external area is sunk so that the edge contour lies below the internal area. A structure is mechanically made in the surface of the edge contour that differs from the optical impression of the surface and imitates a different product.

U.S. Pat. No. 6,638,387 B2 describes a method for embossing a structure into building products. In U.S. Pat. No. 6,638,387 B2, a precured decorative paper with a decorative motif is placed on a board. Reference points are formed on the board before the placement of the decorative paper. The decorative paper is impregnated with melamine resin and the board is then transported into a press that has a three-dimensionally structured press plate. The building board is aligned via the reference points such that the three-dimensional structure of the press plate and the decorative motif coincide so that the pattern and the structure of the press plate correspond to one another. The resin-impregnated paper is cured in the press to embody the laminate material and to produce a product that has a surface texture that exhibits an embossing that corresponds to the respective decorative motif.

However, such techniques have a disadvantage in the use of paper sheets bearing patterns. By way of example, considerable effort in terms of adjustment is necessary in order to compensate for the undefined paper growth through the printing and pressing in order to allow the pattern lines and structure and relief of the embossing to run synchronously with one another. It is a particular disadvantage that the relief and structure are embossed on top in the coating, whereby the optical and tactile impression of a natural product cannot be evoked or can be evoked only very inadequately.

SUMMARY OF THE INVENTION

Based on the above problem, the invention provides an improvement to a generic building board such that the optical and tactile impression of a natural product is imitated in a superior fashion. In the invention, the board can be produced in a simple and cost-effective production method. With the method according to the invention, building boards can be produced that can be used as paneling, in particular as paneling for walls, floors and ceilings as well as furniture fronts.

The method for finishing a building board includes, in embodiments, embossing a structure and/or a relief in at least the top side of the building board. The method further includes an application of a pattern to the embossed side of the building board and sealing of the pattern by the application of an abrasion-resistant layer to the pattern.

An improved optical and tactile impression can be obtained using the invention, so that a natural product, e.g., wood or stone, can be better imitated. This is attainable because a structure and a relief are pressed into the building board and then the pattern is applied. The embossing can have a deep, laminar relief that is designed to imitate, e.g., earlywood/latewood differences and have smaller, less deep structures that are designed to imitate, e.g., pores of the wood. Within the scope of the invention, "relief" refers to laminar depressions and elevations and "structure" refers to fine depressions.

The embossing of the relief and structure can be combined in order, e.g., to imitate a timber floor board that has age structures such as longitudinal joints as a relief, as well as pores of the wood as a structure. Furthermore, the embossing of the relief and structure can be used to imitate a roughly cut stone tile that has laminar chips in the stone surface and joint lines as a relief, as well as fine holes or chips in the stone surface as a structure.

The embossing of a relief is suitable, e.g., for the imitation of a polished stone tile that is surrounded by joint lines or for the imitation of a timber floor board that exhibits age structures such, for example, as longitudinal joints as a relief.

The embossing of a structure is suitable, e.g., for the imitation of a cut timber floor board that has pores of the wood as a structure or for the imitation of a polished stone tile that has fine holes or chips in the stone surface as a structure and with which, e.g., jointless laying can be imitated.

Before the embossing, at least the top side is smoothed or cut preferably by pressing in a press or a roller. The building board is heated to a temperature of about 40° C. to 150° C. before embossing so that it can be embossed more quickly and with a reduced expenditure of force. The building board is preferably cooled to a temperature of about 20° C. to 40° C. after embossing so that structure and relief remain dimensionally accurate, even directly after embossing, and such that the board surface does not spring back. The embossed areas can be prevented in this manner from springing back to their original position again after embossing. The cooling operation can take place in the press or after the pressing operation in a separate cooling zone.

It is advantageous that the lines of the pattern and the structure as well as of the relief coincide so that a natural material can be imitated and the optical and tactile impression of a natural material can be achieved. Alternatively, a fantasy pattern can be printed on the building board. The fantasy pattern can have a structure and a relief.

Within the scope of the invention, fantasy patterns are patterns based on a natural product with adjustments and/or unusual effects. Adjustments can be, e.g., omissions or additions of knotholes in the case of a wood imitation. Unusual effects can be, e.g., coloring deviating from the natural product in the case of a wood or stone imitation.

In particular for building boards that are coated with light papers, e.g., for simple patterns, it can be necessary for a pattern, structure and relief not to correspond to one another and for embossing and the pattern not to be coordinated with one another. Particularly cost-effective and simple building boards can be produced through these embodiments.

Before the embossing at least the top side of the building board can be smoothed by pressing or sanding in order to even out rough surface irregularities in the building board.

It has proven to be advantageous to use MDF or HDF boards that have been produced by use of a 2-glue system as wood material boards, since with these boards a first glue system is suitable for board formation and a further glue system is suitable for postforming. It is advantageous if the MDF or HDF boards are equipped with a softer cover layer 10 so that the embossing can be simplified even further. The use of conventional MDF and HDF boards is also contemplated by the invention. With building boards with a soft cover layer, this does not cure until processing, i.e., until the embossing of the board in the press.

In order to make the surface embossing possible for chipboard, it is advantageous to laminate the chipboard with a light, ashfree paper that can be impregnated. The light, ashfree paper, in embodiments, comprises long-fiber a cellulose with a grammage of 10 to 20 g/m$^2$, preferably 12 g/m$^2$ (so-called "teabag paper"). After lamination, it is advantageous to emboss the structure and the relief into wet-strength paper with minimal paper weight and subsequently to provide it with a pattern. The impregnated "teabag paper" fulfills the function of smoothing the surface of the top side of the boards and of adhering the surface of the top side of the boards to the decorative layer.

Alternatively, it is also contemplated by the invention to use OSB boards that are provided with a smoothed surface that can comprise, e.g., a strongly impregnated paper sheet in which the structure and relief are then embossed. Alternatively, a plastic board can also be used which is composed of recycling plastics and a wood content. The embossing of the relief can be achieved in the pressing device through the partially thermoplastic behavior of the plastic content. It is also contemplated by the invention for the building board to comprise a mixture of wood material and plastic, including recycled plastic.

The embossing can be carried out in a so-called continuous press or feed-through press by a special press belt that has a three-dimensional structure. The speed of the press belt is coordinated with the feed rate of the building board through the feed-through press so that the embossing of the complex pattern lines that run in different directions is rendered possible.

Alternatively, the embossing is also contemplated by at least one three-dimensionally structured pressing plate in a conventional short-cycle press. Moreover, it is also contemplated by the invention to emboss the structure and the relief by a special embossing roller in a calender installation. In particular relatively thin building boards can be produced and/or embossed in a cost-effective manner in these installations.

To decorate the embossed surface, the embossed structure of the pressing plate and the structure of the pattern rollers that apply the pattern are coordinated with one another so that the optical and tactile impression of a natural material can be produced on the finished board.

In order to achieve a pattern-synchronous relief and a pattern-synchronous structure with building boards that have been embossed in a short-cycle press, the alignment of the building board to the pressing plate and/or pattern roller is advantageously made via at least two reference points or reference surfaces that are embodied at or on the building board. In this manner it can be ensured that the relief or structure and pattern are coordinated with one another.

It has proven to be advantageous to achieve a synchronous superimposition of the structure, relief and pattern by direct printing with analogous printing rollers. Advantageously, no paper is used so that the alignment of the decorative paper sheet is omitted and the paper growth does not need to be taken into account. In this manner, a particularly cost-effective method for finishing building boards can be provided.

Alternatively it is also contemplated to embody the pattern by direct printing in digital printing, e.g., with ink-jet printers and to achieve a synchronous superimposition of the structure, relief and pattern. A particularly wide variety of patterns can be realized on the embossed surface of the building board in a simple manner through the use of digital printers, without the use of any special pattern rollers or printing rollers. Advantageously, a decorative paper can be eliminated.

It has proven that the pattern can also be applied by a powder coating. A paper bearing a pattern can be also be used herewith.

In order to ensure that the structure, relief and pattern coincide, the building boards that are embossed in a short-cycle press are aligned with respect to the printing roller or the digital printer or the powder coating via at least two reference points or reference areas.

In order to protect the surface of the building board from mechanical stresses and damage by the effect of moisture, an abrasion-resistant layer of, e.g., a varnish that can be electron-beam cured or a melamine resin coating with and without abrasion-resistant particles, is applied. It is also contemplated to apply a UV-curable varnish, a polyurethane coating or a powder paint as an abrasion-resistant layer.

Through the final coating, the finished building board shows a very homogenous and closed surface. It has been shown that the method of the invention can use relatively low application quantities, despite the high degree of reality that is achieved. This is also a reason why the appearance and the feel of a natural product can be imitated very well, implementing the present invention. This is achieved by the embossing being arranged beneath the pattern and the embossing itself being anchored in the support board. The resistance to abrasion of the abrasion-resistant layer can be further increased if abrasion-resistant particles, e.g., corundum particles, are added to the layer.

The finished building boards are assembled and processed further after the abrasion-resistant coating and after the curing of the same. Within the scope of the further processing, for example, connecting mechanisms corresponding to one another can be milled on opposite side edges of the building board. A tongue and groove embodiment that makes it possible to connect several building boards to one another is in particular suitable for this application. Advantageously, the connecting mechanisms have locking elements so that several building boards can also be connected to one another without glue and can be locked horizontally and vertically, so that a level flooring surface of building boards locked to one another is possible.

A building board comprises at least one of a structure and a relief embossed in a top side of the building board. A pattern is applied over the embossed the top side of the building board and a sealing layer seals the pattern.

The sealing layer is an abrasion-resistant layer. The top side is smooth. The building board is either a MDF or HDF board, or an MDF or at least one of HDF board produced by a 2-glue system and an HDF or MDF board embodied with a soft cover layer that cures during processing. The building board is a chipboard coated with an ashfree paper that can be impregnated and comprises long-fiber a cellulose with a grammage of 10 to 20 g/m$^2$. The building board is an OSB board that has a smoothed surface. The building board is a plastic board of recycling plastics with a wood content. The sealing layer is an abrasion-resistant layer, a varnish that is electron-beam or UV cured, a melamine resin coating with or without abrasion-resistant particles, a polyurethane coating or a powder paint. The building board includes a paper layer on the top side before the embossing. The building board includes light papers to the top side before the embossing. The building board is composed of a wood material, plastic or a mixture of wood material and plastic. The building board is at least one of paneling for walls, floors and ceilings and as a furniture front.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
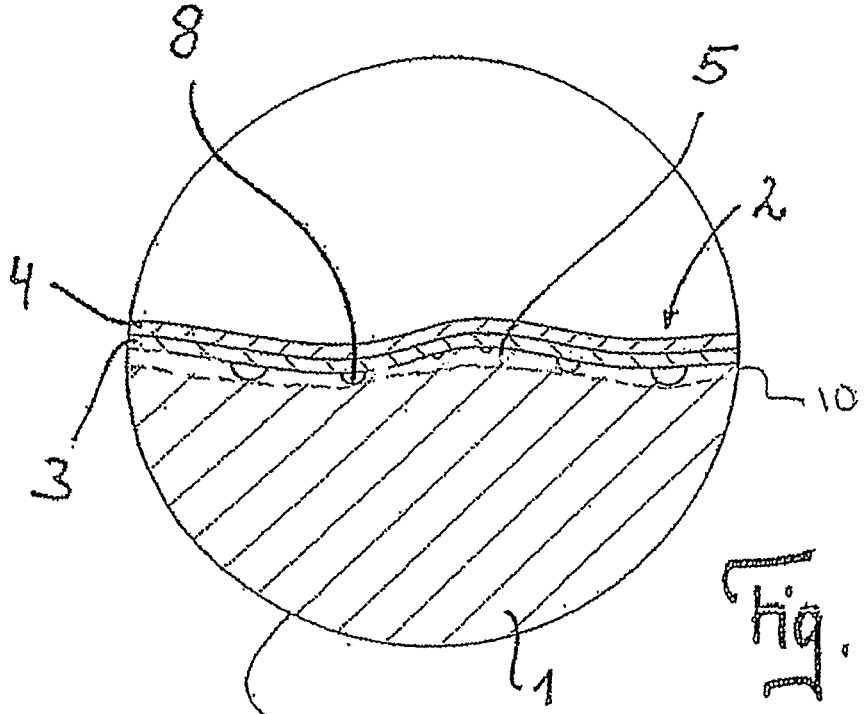
FIG. 1 shows a partial cross section of a building board along line I-I according to FIG. 2.
Figure 2:
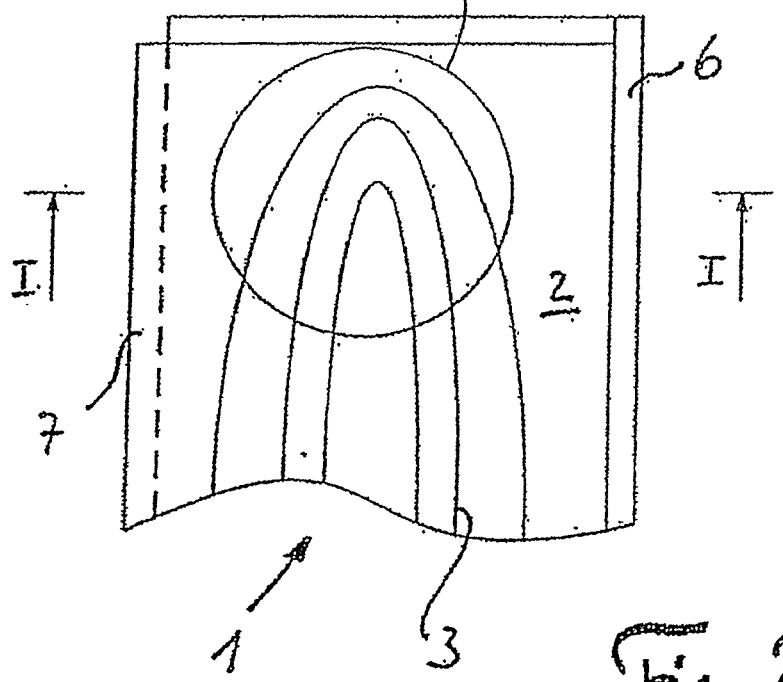
FIG. 2 shows a partial plan view of the top side of the building board.

FIGS. 1 and 2 show various views of a building board. In one embodiment, the building board 1 comprises an MDF or HDF board that has been produced with a 2-glue system and has a first glue system to form the board and another glue system to improve the postforming capability. As noted above, though, the building board may composed of OSB, wood and/or plastics. Before the embossing at least the top side of the building board 1 can be smoothed by pressing or sanding in order to even out rough surface irregularities in the building board.

Figure 3:
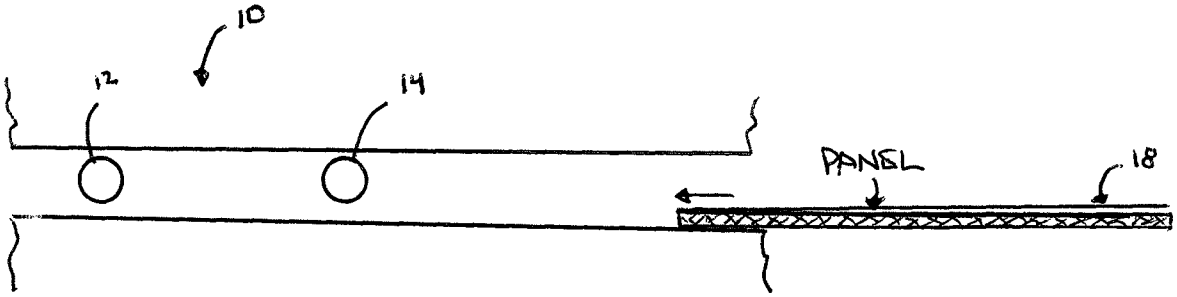
FIG. 3 shows processes in accordance with the invention.

After a preheating to a temperature of about 150° C., the building board 1 is embossed in a feed-through press 10 by a rotating press belt 12 that has a three-dimensional structure. In one embodiment, the building board 1 is heated to a temperature of about 40 to 150° C. before embossing so that it can be embossed more quickly and with a reduced expenditure of force. By using the press belt, a relief 5 and structure 8 have been embossed in a top side 2 of the building board 1. The rotational speed of the press belt 12 and the feed rate of the building board 1 through the feed-through press 10 (see, FIG. 3) are coordinated with one another so that an exact embossing of the relief 5 and the structure 8 in the surface 2 of the building board 1 takes place.

It should be understood that the embossing can be carried out in a so-called continuous press or feed-through press by a special press belt that has a three-dimensional structure. The speed of the press belt is coordinated with the feed rate of the building board through the feed-through press so that the embossing of the complex pattern lines that run in different directions is rendered possible. A roller in a calendar installation can also carry out the embossing, or at least one three-dimensionally structured pressing plate in a conventional short-cycle press.

Following the embossing operation (e.g., in the feed-through press), the building board 1 is cooled in a cooling zone to a temperature of about 20° C. in order to prevent the relief 5 and the structure 8 from springing back to the original position. In embodiments, the cooling can be at a temperature of about 20 to 40° C.

Following the embossing, the application of the pattern 3 to the top side 2 of the building plate 1 takes place. The pattern 3 is applied to the embossed surface 2 of the building board 1 by digital printing that is carried out with an ink-jet printer. The relief 5, structure 8 and pattern 3 correspond so that a wood surface is imitated. The pattern can also be applied by a powder coating or printing roller 14.

After the curing of the pattern 3, the application of the abrasion-resistant layer 4 to the decorative layer 3 takes place. The abrasion-resistant layer 4 comprises a varnish capable of being electron-beam cured. The varnish can be provided with abrasion-resistant particles, e.g., corundum particles, to increase the abrasion resistance. Melamine resin coating with and without abrasion-resistant particles can also be applied. It is also contemplated to apply a UV-curable varnish, a polyurethane coating or a powder paint as an abrasion-resistant layer. After the curing of the abrasion-resistant layer 4, further assembly and further processing of the building board 1 takes place, e.g., to form wall, ceiling or flooring panels.

Figure 4:
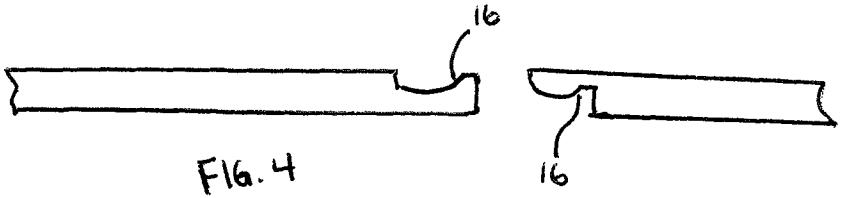
FIG. 4 shows locking mechanisms of the building board.

Connection mechanisms 6 and 7 corresponding to one another are embodied on the opposite side edges of the building board 1. In embodiments, the connection mechanisms 6 and 7 are embodied as tongue and groove. To lock several building boards 1 to one another, the connecting mechanism 6 and 7 are provided with locking mechanisms 16 for the mechanical locking of the building boards 1 to one another in the horizontal and vertical direction (see, FIG. 4.

To make the surface embossing possible for chipboard, the invention contemplates laminating the chipboard with a light, ashfree paper that can be impregnated. The light, ashfree paper 18 comprises long-fiber a cellulose with a grammage of 10 to 20 g/m$^2$, preferably 12 g/m$^2$. After lamination, the chipboard can be embossed with the structure and the relief into wet-strength paper with minimal paper weight and subsequently to provide it with a pattern.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A method for finishing a building board having a top side, an underside and opposite side edges, comprising:

embossing at least one of a structure and a relief into the at least top side of the building board;

applying a pattern to the embossed at least the top side of the building board; and sealing of the pattern, after curing of the pattern, wherein by applying an abrasion-resistant layer to the pattern, which is a varnish that is electron-beam cured or a melamine resin coating with or without abrasion-resistant particles, the building board is heated to a temperature of about 40-150° C. before the embossing; and the building board is a chipboard coated with an ashfree paper that is impregnated and comprises long-fiber a cellulose with a grammage of 10 to 20 g/m$^2$, the ashfree paper being applied the top side of the building board prior to the embossing, the embossing takes place by a press belt in a feed-through press.

2. The method according to claim 1, wherein the pattern and the at least one of the structure and the relief coincide so that a natural material is imitated.

3. The method according to claim 1, wherein the pattern is applied by printing rollers.

4. The method according to claim 1, wherein the pattern is applied by digital printing.

5. The method according to claim 1, wherein the building board is at least one of paneling for walls, floors and ceilings and as a furniture front.

6. The method according to claim 1, wherein the pattern is applied by ink printing after the embossing.

7. The method according to claim 1, wherein the building board is chipboard coated with the ashfree paper that is impregnated and comprises long-fiber the cellulose with a grammage of 12 g/m$^2$.

8. The method according to claim 1, wherein the at least one of the structure and the relief are directly embossed into the chipboard with the ashfree paper.

9. A method for finishing a building board having a top side, an underside and opposite side edges, comprising:

embossing at least one of a structure and a relief into the at least top side of the building board;

applying a pattern to the embossed at least the top side of the building board; and sealing of the pattern, after curing of the pattern, by applying an abrasion-resistant layer to the pattern with or without abrasion-resistant particles, wherein:

the building board is heated to a temperature of about 40-150° C. before the embossing; and the building board is a chipboard coated with an ashfree paper that is impregnated and comprises long-fiber a cellulose with a grammage of 10 to 20 g/m$^2$, the ashfree paper being applied the top side of the building board prior to the embossing, the embossing takes place by a press belt in a feed-through press.

10. The method according to claim 9, wherein the abrasion-resistant layer is a varnish that is electron-beam cured or that is UV cured.

11. The method according to claim 9, wherein the abrasion-resistant layer is a polyurethane coating or a melamine resin coating.

12. The method according to claim 9, wherein the pattern is applied by digital printing.

* * * * *